US007760150B2

(12) United States Patent
Sato

(10) Patent No.: US 7,760,150 B2
(45) Date of Patent: Jul. 20, 2010

(54) ANTENNA ASSEMBLY AND WIRELESS UNIT EMPLOYING IT

(75) Inventor: Junji Sato, Tokyo (JP)

(73) Assignee: Panasonic Corporation, Osaka (JP)

( * ) Notice: Subject to any disclaimer, the term of this patent is extended or adjusted under 35 U.S.C. 154(b) by 429 days.

(21) Appl. No.: 11/568,985

(22) PCT Filed: Apr. 14, 2005

(86) PCT No.: PCT/JP2005/007244

§ 371 (c)(1),
(2), (4) Date: Nov. 13, 2006

(87) PCT Pub. No.: WO2005/112194

PCT Pub. Date: Nov. 24, 2005

(65) Prior Publication Data

US 2008/0231526 A1 Sep. 25, 2008

(30) Foreign Application Priority Data

May 18, 2004 (JP) ..... 2004-147267
Feb. 18, 2005 (JP) ..... 2005-042572

(51) Int. Cl.
*H01Q 1/00* (2006.01)
*H01Q 21/00* (2006.01)
*H01Q 19/10* (2006.01)
*H01Q 19/00* (2006.01)

(52) U.S. Cl. ..... 343/724; 343/722; 343/726; 343/729; 343/730; 343/818; 343/833

(58) Field of Classification Search ..... 343/722, 343/724, 726, 729, 730, 741, 748, 818, 833, 343/866, 868, 702
See application file for complete search history.

(56) References Cited

U.S. PATENT DOCUMENTS 6,947,007 B1 * 9/2005 Rohde et al. ..... 343/804
2004/0070548 A1 * 4/2004 Cake ..... 343/803

FOREIGN PATENT DOCUMENTS

JP 54127616 A * 10/1979

(Continued)

OTHER PUBLICATIONS

Takahashi, English translation of JP 54-127616.*

*Primary Examiner*—Douglas W Owens
*Assistant Examiner*—Jennifer F Hu
(74) *Attorney, Agent, or Firm*—Pearne & Gordon LLP

(57) ABSTRACT

An object of the invention is to provide an antenna apparatus whose directional characteristic can be switched 90 degrees conforming to the communication mode at the same time as the frequency band can be switched in response to the communication mode for application to a multiband radio for covering different communication modes such as voice communications and data communications, and a radio using the antenna apparatus.

An antenna apparatus 1 of the invention includes linear radiator 2, 3; a first linear director 4; and first and second linear conductors 5 and 6 connected at one end to the radiator 2, 3and at an opposite end to the first director 4 through switches 7. The first and second conductors 5 and 6 are disposed symmetrically with respect to an orthogonal plane in the length direction of the radiator, and the radiator 2, 3, the first director 4, the first conductor 5, and the second conductor 6 are switched between a loop state in which they are connected like a loop and a separate state in which they are separate by switching the switches 7.

23 Claims, 12 Drawing Sheets

FOREIGN PATENT DOCUMENTS

| | | | |
|---|---|---|---|
| JP | 57-127616 | | 8/1982 |
| JP | 8-163015 | | 6/1996 |
| JP | 2000-236209 | | 8/2000 |
| JP | 2000-244219 | | 9/2000 |
| JP | 2001-148609 | | 5/2001 |
| JP | 2001148609 | A * | 5/2001 |

* cited by examiner

ANTENNA ASSEMBLY AND WIRELESS UNIT EMPLOYING IT

TECHNICAL FIELD

This invention relates to an antenna apparatus that can be used in a plurality of frequency bands and a radio using the antenna apparatus.

BACKGROUND ART

A multifrequency share antenna configuration using diode switches is proposed as a multiband antenna configuration that can be applied to a multiband radio for integrating a plurality of wireless communication systems (for example, refer to patent document 1).

FIG. 9 is a schematic configuration drawing of a multifrequency share antenna in a related art described in patent document 1. In FIG. 9, numerals 101*a* to 101*d* denote metal pieces, numerals 102*a* and 102*b* denote diode switch circuits, numerals 103*a* to 103*d* denote high frequency signal shutdown choke coils, numerals 104*a* and b denote ground, numeral 105 denotes a control terminal, numeral 106 denotes a high frequency signal input/output terminal, and numeral 107 denotes a balanced line.

In the described configuration, the operation is as follows: In FIG. 9, a balance signal is input to the high frequency signal input/output terminal 106 and left and right dipole antenna elements are formed of two pairs of metal pieces 101*a* to 101*d* and the diode switch circuits 102*a* and 102*b* are included each between the metal pieces.

The metal pieces 101*a* to 101*d* are short-circuited through the high frequency signal shutdown choke coils 103*a* to 103*d*. A control signal is input from the control terminal 105 connected through the high frequency signal shutdown choke coils 103*a* to 103*d* in the high frequency signal input/output terminal 106 of the dipole antenna or in the proximity thereof.

In such a state, if the voltage applied from the control terminal 105 is zero, the diode switch circuits 102*a* and 102*b* do not operate and the excited elements are only the basic metal pieces 101*a* and 101*b* and resonate at a high frequency.

On the other hand, a bias voltage for the diode switch circuits 102*a* and 102*b* to operate is applied from the control terminal 105, whereby the diode switch circuits 102*a* and 102*b* are brought into conduction and the metal pieces 101*a* to 101*d* form the element length and thus resonance occurs at a low frequency.

Such a configuration is adopted, whereby the element length of the dipole antenna can be changed for efficiently producing resonance at a plurality of single frequencies by performing simple control of changing the bias voltage applied from the control terminal 105.

On the other hand, a configuration of switching between a loop antenna and a dipole antenna by a switch is proposed as a configuration of switching the directional characteristic of an antenna by turning on and off a switch (for example, refer to patent document 2).

FIG. 10 is a schematic configuration drawing of an antenna in a related art described in patent document 2. In FIG. 10, numeral 111 denotes a diversity antenna, numeral 112 denotes one side of a dipole antenna, numeral 113 denotes a feeding point, numeral 114 denotes an opposite side parallel with the one side 112, numeral 115 denotes one loading point, and numerals 116 and 117 denote switches.

The configuration as in FIG. 10 is adopted, whereby the diversity antenna 111 can operate as a loop antenna by turning on the switches 116 and 117 and can operate as a linear dipole antenna by turning off the switches 116 and 117, so that the two functions can be used properly with one antenna, whereby the two antennas can be switched for providing the diversity effect.

Patent document 1: JP-A-2000-236209

Patent document 2: JP-A-8-163015

DISCLOSURE OF THE INVENTION

Problems that the Invention is to Solve

The use mode of a multiband radio compatible with various wireless communication systems varies depending on the system. For example, for voice communications, the user pushes the radio against the head side to use the radio; to conduct data communications, the user conducts communications while checking the display of the radio. Thus, the directivity demanded for the radio changes depending on the communication mode.

That is, the following configuration is desirable: To place the radio on the head side as in voice communications, the maximum radiation direction of the antenna becomes the rear direction of the radio and to place the radio at a position where the user can check the display of the radio as in data communications, the maximum radiation direction of the antenna becomes the zenith direction of the radio.

Thus, it is desirable that the antenna in the multiband radio should have a configuration such that the antenna can be switched between frequency bands and that the maximum radiation direction of the antenna can be switched 90 degrees depending on the frequency band (use mode).

Further, for example, assuming a wireless LAN, etc., using a 5-GHz band as data communications, a high antenna gain is required as compared with voice communications to secure high-speed, large-capacity communications and to compensate for the propagation loss in space.

The configuration as in patent document 1 described above is used, whereby the antenna resonance length is changed and thus the resonance frequency can be easily switched while interference from other frequency bands is suppressed in the multiband radio. In the configuration, however, the configuration of the antenna does not change if the resonance frequency is changed and thus switching the directional characteristic of the antenna depending on the frequency band cannot be accomplished.

The configuration as in patent document 2 described above is used, so that the directional characteristic of the antenna can be changed by switching the switch. However, patent document 2 does not mention frequency switching by the switch to provide the diversity effect with one antenna.

Further, the loop antenna and the dipole antenna do not allow the maximum radiation direction of the antenna to be switched 90 degrees and thus the configuration is not appropriate as the antenna configuration in the multiband radio for covering both voice communications and data communications.

It is therefore an object of the invention to provide an antenna apparatus whose directional characteristic can be switched 90 degrees conforming to the communication mode at the same time as the frequency band can be switched in response to the communication mode for application to a multiband radio for covering different communication modes such as voice communications and data communications, and a radio using the antenna apparatus.

Means for Solving the Problems

The antenna apparatus of the invention is an antenna apparatus including a linear radiator, a first linear director, and first and second linear conductors each being connected at one end to the radiator and at an opposite end to the first director through switches, wherein the first and second conductors are disposed symmetrically with respect to an orthogonal plane in the length direction of the radiator, and wherein the radiator, the first director, the first conductor, and the second conductor are switched between a loop state in which they are connected like a loop and a separate state in which they are separate by switching the switches.

In the antenna apparatuses in the related arts, it is impossible to switch the maximum radiation direction of the antenna 90 degrees in response to communication modes different in frequency band such as voice communications and data communications and the antenna configuration is not adequate as the antenna configuration in a multiband radio. According to the configuration of the invention, when the switches are short-circuited, the radiator, the director, and the first and second conductors form a loop antenna and when the switches are opened, the radiator and the director form a Yagi-Uda antenna. Thus, the maximum radiation direction of the antenna can be switched 90 degrees at the same time as the frequency band of the antenna can be switched as the switches are short-circuited and are opened.

The antenna apparatus of the invention includes control means for controlling switching the switches.

According to the configuration, the switch can be switched between being short-circuited and opened at any desired point in time, so that the convenience of the antenna improves.

In the antenna apparatus of the invention, the radiator, the first director, and the first and second conductors connected through the switches form a rectangular structure.

According to the configuration, the radiator, the first director, and the first and second conductors form a rectangular structure on the same plane, so that a high antenna gain when the switches are short-circuited is obtained.

The antenna apparatus of the invention has first and second variable reactive elements connected to the first and second conductors.

In the antenna apparatus of the invention, the first and second variable reactive elements are inserted onto the lines of the first and second conductors.

According to the configuration, the reactance values of the two reactive elements are changed, whereby the left and right balance of the antenna is adjusted and the directional characteristic can be controlled.

In the antenna apparatus of the invention, one ends of the first and second conductors are connected at right angles to at least either the radiator or the first director.

In the antenna apparatus of the invention, the radiator, the first director, and the first and second conductors connected through the switches form a convex structure on the same plane.

In the antenna apparatus of the invention, the radiator, the first director, and the first and second conductors connected through the switches form a concave structure on the same plane.

According to the configuration, when the switches are short-circuited, if the first and second conductors are positioned in the proximity of the radiator and the director, electromagnetic field coupling can be minimized.

The antenna apparatus of the invention includes a second linear director placed between the radiator and the first director.

In the antenna apparatus of the invention, the first director and the second linear director are placed in parallel with the radiator.

According to the configuration, electric field coupling of the radiator and the director can be strengthened through the second director, so that the effect of electric field coupling occurring between the radiator and the first and second conductors can be lessened.

In the antenna apparatus of the invention, power is fed into the radiator using a balanced line.

According to the configuration, the effect of GND on the antenna can be suppressed and when the board on which the antenna is installed is minimized, the characteristic can be made stable.

In the antenna apparatus of the invention, power is fed into the radiator using an unbalanced line.

According to the configuration, it becomes unnecessary to use a balanced-to-unbalanced line conversion circuit, etc., and when the antenna is installed, the number of parts can be reduced.

In the antenna apparatus of the invention, the radiator, the first detector, and the first and second conductors are formed according to a conductor pattern on a dielectric substrate.

According to the configuration, the antenna can be manufactured as printed circuit board work by etching, etc., so that productivity can be enhanced with stable characteristic and the antenna can be miniaturized.

In the antenna apparatus of the invention, the radiator, the first detector, and the first and second conductors are formed on the surface of and/or inside a dielectric chip.

According to the configuration, the radiator, the director, and the first and second conductors can be placed in such a manner that they are folded three-dimensionally and thus the design flexibility of the antenna increases and the antenna installation area can be made small.

In the antenna apparatus of the invention, the radiator comprises first and second linear radiators having the same length, and the control means comprises a first choke coil connected at one end to the first radiator and grounded at an opposite end, and a second choke coil connected at one end to the second radiator and at an opposite end to a control terminal and a bypass capacitor grounded at one end.

According to the configuration, the operation of short-circuiting and opening a plurality of switches can be controlled at the same time according to the minimum control circuit configuration.

In the antenna apparatus of the invention, the radiator comprises first and second linear radiators having the same length, and the control means comprises a first choke coil connected at one end to the first and second radiators and the first director and grounded at an opposite end, and a second choke coil connected at one end to the first and second conductors and at an opposite end to a control terminal and a bypass capacitor grounded at one end.

According to the configuration, the operation of short-circuiting and opening a plurality of switches can be controlled at the same time and the control voltage applied to two terminals is changed, whereby the left and right balance of the antenna is adjusted and the directional characteristic can be controlled.

In the antenna apparatus of the invention, the radiator comprises first and second linear radiators having the same length, the control means includes a first stub connected at one end to the first radiator, a first resonance circuit connected at one end to an opposite end of the first stub and grounded at an opposite end, the first resonance circuit for resonating in a first frequency band, a second stub connected at one end to the opposite end of the first stub and grounded at an opposite end, a third stub connected at one end to the second radiator, a second resonance circuit connected at one end to an opposite end of the third stub and grounded at an opposite end, the second resonance circuit for resonating in the first frequency band, and a fourth stub connected at one end to the opposite end of the third stub and at an opposite end to a control terminal and a bypass capacitor grounded at one end, and the length of each of the first and third stubs becomes one quarter wavelength in the first frequency band and the sum of the lengths of the first and second stubs and the sum of the lengths of the third and fourth stubs become each one quarter wavelength in a second frequency band lower than the first frequency band.

According to the configuration, the operation of short-circuiting and opening a plurality of switches can be controlled and parts such as a coil are not directly installed in the components of the antenna, so that stable characteristic free of an error caused by installation variations, single-unit variations of parts, etc., can be provided.

In the antenna apparatus of the invention, the radiator comprises first and second linear radiators having the same length, the control means includes a first stub connected at one end to the first and second radiators and the first director, a first resonance circuit connected at one end to an opposite end of the first stub and grounded at an opposite end, the first resonance circuit for resonating in a first frequency band, a second stub connected at one end to the opposite end of the first stub and grounded at an opposite end, a third stub connected at one end to the first and second conductors, a second resonance circuit connected at one end to an opposite end of the third stub and grounded at an opposite end, the second resonance circuit for resonating in the first frequency band, and a fourth stub connected at one end to the opposite end of the third stub and at an opposite end to a control terminal and a bypass capacitor grounded at one end, and the length of each of the first and third stubs becomes one quarter wavelength in the first frequency band and the sum of the lengths of the first and second stubs and the sum of the lengths of the third and fourth stubs become each one quarter wavelength in a second frequency band lower than the first frequency band.

According to the configuration, the operation of short-circuiting and opening a plurality of switches can be controlled and the control voltage applied to two terminals is changed, whereby the left and right balance of the antenna is adjusted and the directional characteristic can be controlled. Further, parts such as a coil are not directly installed in the components of the antenna, so that stable characteristic free of an error caused by installation variations, single-unit variations of parts, etc., can be provided.

In the antenna apparatus of the invention, the switch consists of diodes.

In the antenna apparatus of the invention, the switch consists of MEMS switches.

According to the configuration, the switch part can be miniaturized and therefore the antenna can also be miniaturized.

The radio of the invention is a radio using the antenna apparatus of the invention.

According to the configuration, the antenna characteristic can be changed in response to different communication modes for conducting high-quality communications.

ADVANTAGES OF THE INVENTION

According to the antenna apparatus of the invention and the radio using the antenna apparatus, when the switches are short-circuited, the radiator, the director, and the first and second conductors form a loop antenna and when the switches are opened, the radiator and the director form a Yagi-Uda antenna. Thus, the maximum radiation direction of the antenna can be switched 90 degrees at the same time as the frequency band of the antenna can be switched as the switches are short-circuited and are opened, and the antenna characteristic can be changed in response to communication modes different in frequency band such as voice communications and data communications for conducting high-quality communications.

DESCRIPTION OF REFERENCE NUMERALS

Figure 1:
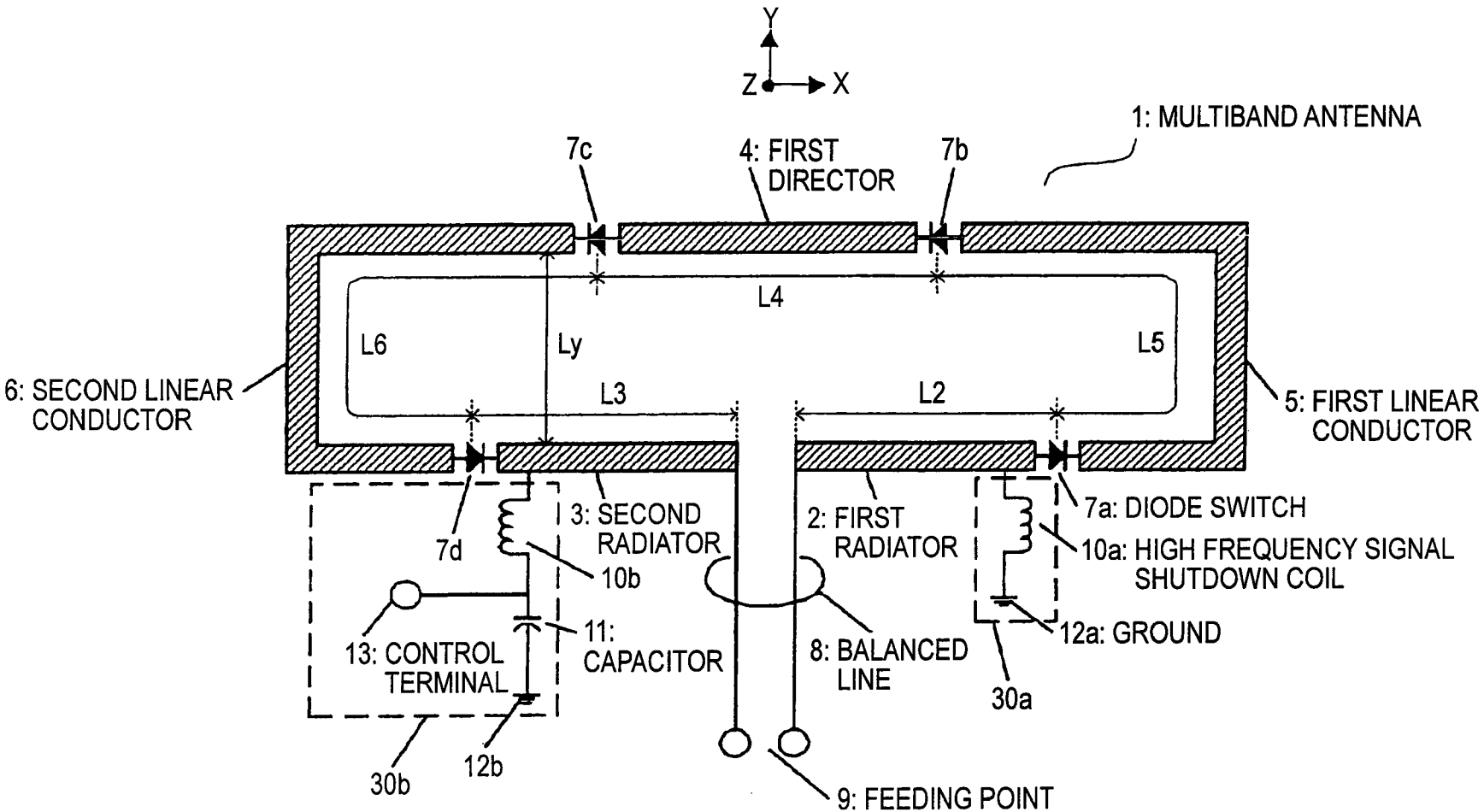
[FIG. 1] A schematic configuration drawing of a multiband antenna according to a first embodiment of the invention.

1 Multiband antenna
2 First radiator
3 Second radiator
4 First director
5 First linear conductor
6 Second linear conductor
7 Diode switch
8 Balanced line
9 Feeding point
10 Choke coil
11 Capacitor
12 Ground
13 Control terminal
14 First stub
15 Capacitor
16 Coil
17 Resonance circuit
18 Second stub
19 Convex multiband antenna
20 Third linear conductor
21 Fourth linear conductor
22 Concave multiband antenna

23 Fifth linear conductor
24 Sixth linear conductor
25 Multiband antenna
26 Second director
27 Multiband antenna of bilaterally symmetric structure
28 Multiband dielectric chip antenna
29 Dielectric chip
30, 31 Control circuit
32 First variable reactive element
33 Second variable reactive element
101*a*-101*d* Metal piece
102*a*, 102*d* Diode switch circuit
103*a*-103*d* High frequency signal shutdown choke coil
104 Ground
105 Control terminal
106 High frequency input/output terminal
107 Balanced line
111 Diversity antenna
112 One side
113 Feeding point
114 Opposite side
115 Loading point
116, 117 Switch

BEST MODE FOR CARRYING OUT THE INVENTION

The essence of the invention is the antenna configuration including a first radiator, a second radiator, a director, a first conductor, a second conductor, switches for connecting the components, and control circuits for controlling the switches, thereby providing the antenna configuration wherein the antenna characteristic can be switched between a loop antenna and a Yagi-Uda antenna by the on/off operation of the switches and frequency and the directional characteristic can be switched at the same time.

Embodiments of the invention will be discussed with the accompanying drawings.

First Embodiment

FIG. 1 is a schematic configuration drawing of a multiband antenna according to a first embodiment of the invention. In FIG. 1, numeral 1 denotes a multiband antenna, numeral 2 denotes a first radiator formed of a linear conductor, numeral 3 denotes a second radiator formed of a linear conductor, numeral 4 denotes a first director formed of a linear conductor, numeral 5 denotes a first conductor formed of a linear conductor, numeral 6 denotes a second conductor formed of a linear conductor, numerals 7*a* to 7*d* denote diode switches, numeral 8 denotes a balanced line, numeral 9 denotes a feeding point, numerals 10*a* and 10*b* denote choke coils, numeral 11 denotes a capacitor, numerals 12*a* and 12*b* denote ground, and numeral 13 denotes a control terminal.

Opposed one ends of the first and second radiators 2 and 3 of the basic elements of the antenna are connected to the feeding point 9 through the balanced line 8. Opposite ends of the first and second radiators 2 and 3 are connected to one ends of the first and second conductors 5 and 6 through the diode switches 7*a* and 7*d*.

Opposite ends of the first and second conductors 5 and 6 are connected to the first director 4 through the diode switches 7*b* and 7*c*. One ends of the choke coils 10*a* and 10*b* are connected to the first and second radiators 2 and 3 as control of the diode switches 7*a* to 7*d*.

An opposite end of the choke coil 10*a* connected to the first radiator 2 is grounded by the ground 12*a* and the control terminal 13 and the capacitor 11 for grounding a high frequency signal are connected to an opposite end of the choke coil 10*b* connected to the second radiator 3 and the opposite end is grounded by the ground 12*b*.

In the described configuration, the operation is as follows: A high frequency signal fed from the feeding point 9 is transmitted to the first and second radiators 2 and 3 through the balanced line 8. At this time, a negative control voltage is applied to the control terminal 13, whereby the diode switches 7*a* to 7*d* are brought into conduction, connecting the first and second radiators 2 and 3, the first director 4, and the first and second conductors 5 and 6 for operation as a loop antenna.

On the other hand, if a control voltage is not applied to the control terminal 13, the diode switches 7*a* to 7*d* are brought out of conduction and the antenna operates as a two-element Yagi-Uda antenna by the first and second radiators 2 and 3 and the first director 4. In this case, it is desirable that the first and second conductors 5 and 6 should be placed so as not to affect the operation of the two-element Yagi-Uda antenna as much as possible because the first and second conductors 5 and 6 become parasitic elements.

If the diode switches 7*a* to 7*d* are brought into conduction for causing the antenna to operate as the loop antenna, the directional characteristic of the antenna becomes a bidirectional characteristic such that the ±Z direction in FIG. 1 becomes the maximum radiation direction; if the diode switches 7*a* to 7*d* are brought out of conduction for causing the antenna to operate as the two-element Yagi-Uda antenna, the directional characteristic of the antenna becomes a unidirectional characteristic such that the +Y direction in FIG. 1 becomes the maximum radiation direction.

Here, setting is made so that the circumferential length of the loop antenna, namely, sum total Lt of the lengths of the first and second radiators 2 and 3 (L2 and L3), the first director 4 (L4), and the first and second conductors 5 and 6 (L5 and L6) approximately becomes one wavelength (λ1) in a low frequency band (F1).

$$L2+L3+L4+L5+L6=Lt\approx\lambda 1 \quad \text{[Expression 1]}$$

Setting is made so that each of the lengths of the first and second radiators 2 and 3 (L2 and L3) of the two-element Yagi-Uda antenna approximately becomes a quarter of one wavelength (λ2) in a high frequency band (F2).

$$L2=L3\approx(\lambda 2)/4 \quad \text{[Expression 2]}$$

Setting is made so that the length of the first director 4 (L4) in the two-element Yagi-Uda antenna becomes a little shorter than a half of one wavelength (λ2) in the high frequency band (F2).

$$L4<(\lambda 2)/2 \quad \text{[Expression 3]}$$

Further, spacing Ly between the first director 4 and the first, second radiator 2, 3 in the Y axis direction approximately becomes a quarter of one wavelength (λ2) in the high frequency band (F2).

$$Ly\approx(\lambda 2)/4 \quad \text{[Expression 4]}$$

Such settings are made, whereby it is made possible to realize the operation such that the maximum radiation direction of the antenna directional characteristic switches 90 degrees at the same time as the frequency is switched when the diode switches 7*a* to 7*d* are brought into or out of conduction.

Figure 2:
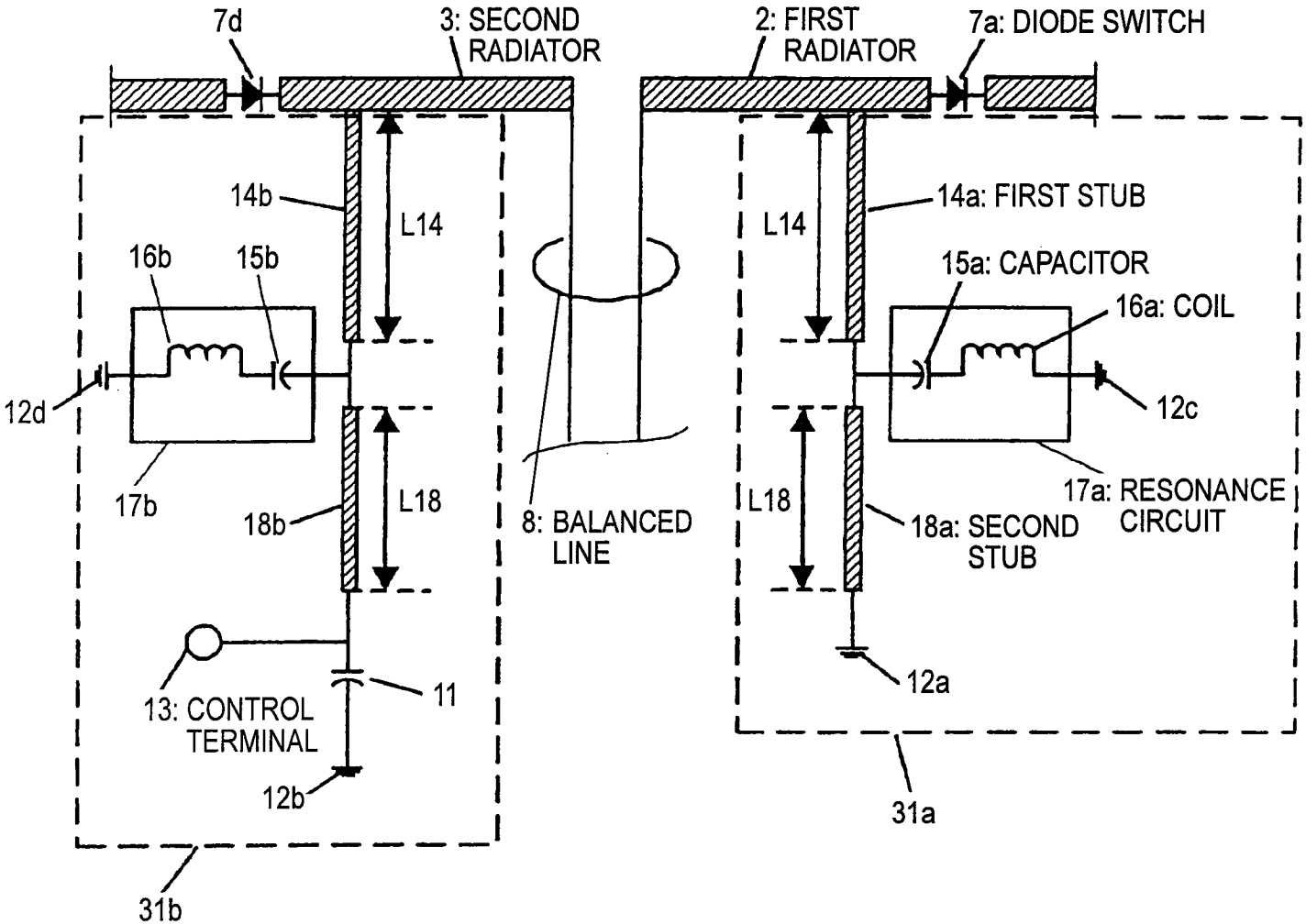
[FIG. 2] A drawing to show a configuration example of a control circuit in the multiband antenna according to a first embodiment of the invention.

As control circuits 30*a* and 30*b* for applying a control voltage to the diode switches 7*a* to 7*d*, the choke coils 10*a* and 10*b* and the capacitor 11 may be used as shown in FIG. 1 and the constants of the choke coils 10*a* and 10*b* may be set so that the impedances of the coil parts become sufficiently high as compared with the impedances of the first and second radiators 2 and 3 at the loop antenna operation time and at the two-element Yagi-Uda antenna operation time, or a configuration as shown in FIG. 2 may be adopted.

FIG. 2 shows a schematic configuration for applying a control voltage to the diode switches 7*a* to 7*d* using stubs in place of the choke coils 10*a* and 10*b* in FIG. 1. That is, first stubs 14*a* and 14*b* are used in place of the choke coils 10*a* and 10*b* and are connected at one ends to the first and second radiators 2 and 3 and are grounded at opposite ends by grounds 12*c* and 12*d* through a resonance circuit 17*a* made up of a capacitor 15*a* and a coil 16*a* or a resonance circuit 17*b* made up of a capacitor 15*b* and a coil 16*b*, and one ends of second stubs 18*a* and 18*b* are connected to the opposite ends of the first stubs 14*a* and 14*b* through the resonance circuit.

An opposite end of the second stub 18*a* connected to the first radiator 2 side is grounded by the ground 12*a*. The control terminal 13 is connected to an opposite end of the second stub 18*b* connected to the second radiator 3 side and the capacitor 11 for grounding a high frequency signal is also connected.

Such described control circuits 31*a* and 31*b* are adopted and setting is made so that the length of the first stub 14*a*, 14*b*, L14, becomes a quarter of one wavelength (λ2) at the two-element Yagi-Uda antenna operation time (high frequency band: F2).

$$L14 \approx (\lambda 2)/4 \quad \text{[Expression 2]}$$

Constants of the capacitor 15*a*, 15*b* and the coil 16*a*, 16*b* are selected so that the resonance circuit 17*a*, 17*b* resonates at the two-element Yagi-Uda antenna operation time (high frequency band: F2).

Further, setting is made so that the sum of the lengths of the first stub 14*a* and the second stub 18*a* and the sum of the lengths of the first stub 14*b* and the second stub 18*b* (L14+L18) become each a quarter of one wavelength (λ1) at the loop antenna operation time (low frequency band: F1).

$$L14+L18 \approx (\lambda 1)/4 \quad \text{[Expression 6]}$$

The configuration is adopted, whereby it is made possible to maintain any desired antenna characteristic without receiving the effect of the control circuit 31*a*, 31*b* for applying the control voltage at the loop antenna operation time and at the two-element Yagi-Uda antenna operation time.

Since mounted parts such as the choke coils 10*a* and 10*b* shown in FIG. 1 are not included, it is made possible to produce antennas having stable characteristics without characteristic change caused by mounting in large quantity.

Further, if the impedances of the first and second stubs, 14*a*, 14*b*, 18*a*, and 18*b* are made sufficiently higher than the impedances of the first and second radiators 2 and 3 by sufficiently making narrow the line width of the first stub 14*a*, 14*b*, the second stub 18*a*, 18*b* as compared with the line width of the first, second radiator 2, 3, the effects of the control circuits 31*a* and 31*b* can be furthermore lessened.

As described above, the antenna is made up of the first and second radiators 2 and 3, the first director 4, the first and second conductors 5 and 6, and the diode switches 7*a* to 7*d* and the diode switches 7*a* to 7*d* are turned on and off according to the control voltage, whereby the operation of the antenna can be switched between the loop antenna and the two-element Yagi-Uda antenna, so that it is made possible to implement a multiband antenna 1 whose directional characteristic is switched 90 degrees at the same time as the resonance frequency is switched.

Further, a radio is configured using the multiband antenna shown in the embodiment, so that the characteristic of the antenna can be changed in response to a different communication mode for improving the performance of the radio and it is made possible to provide a highly reliable radio.

Figure 11:
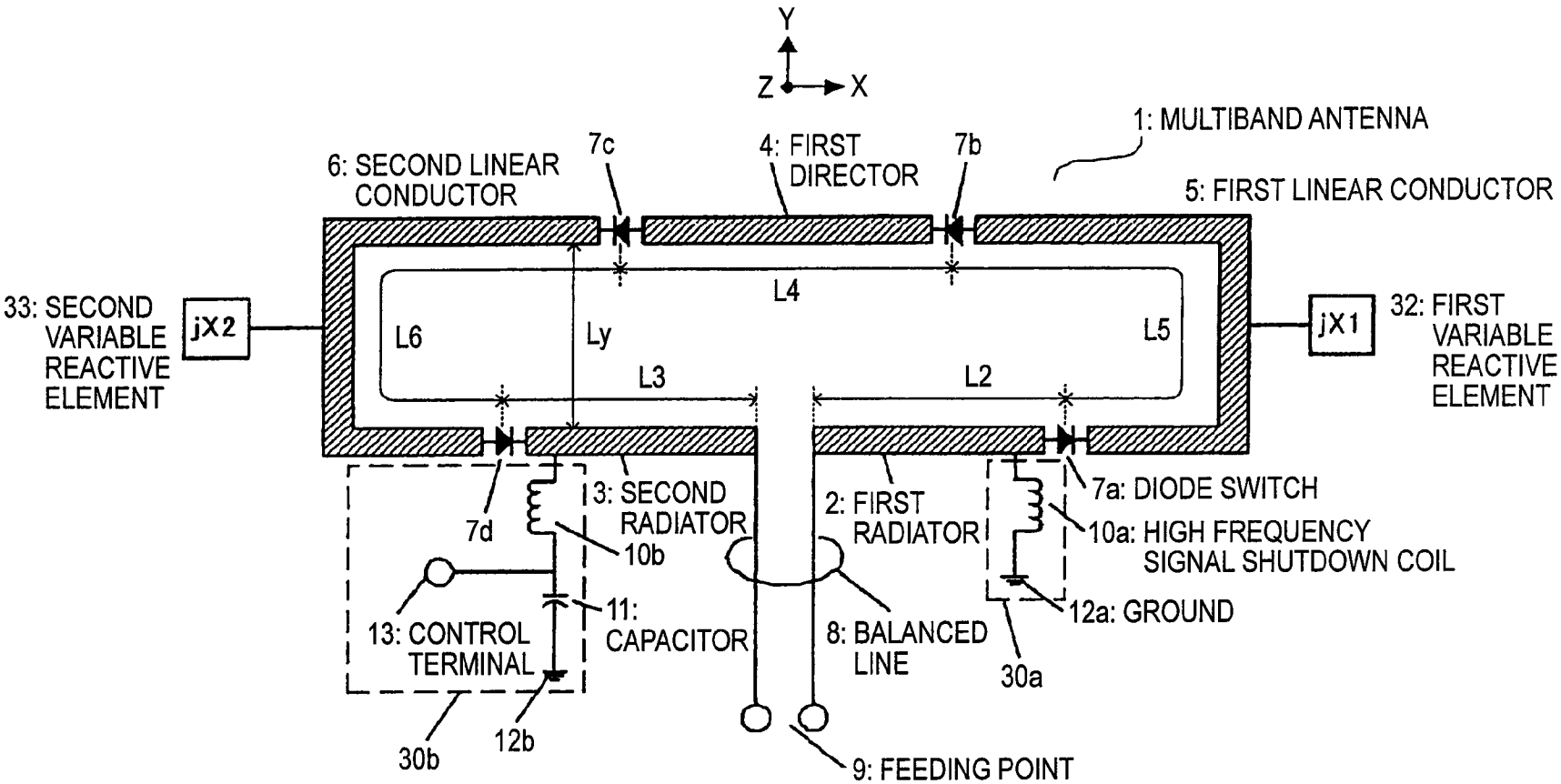
[FIG. 11] A schematic configuration example of a multiband antenna to which reactive elements are added according to the first embodiment of the invention.

A first variable reactive element 32 and a second variable reactive element 33 may be connected to the first linear conductor 5 and the second linear conductor 6 respectively as shown in FIG. 11. For example, if a reactance value X1 of the first variable reactive element 32 and a reactance value X2 of the second variable reactive element 33 are set to different values, when the control voltage is not applied to the control terminal 13, namely, when the antenna is operated as the Yagi-Uda antenna, the balance in the ±X direction in FIG. 11 can be changed. Thus, the value of the first or second variable reactive element is changed, whereby directivity can also be controlled in the XY plane and three-dimensional directivity control is made possible. At this time, for example, a stub is used as each variable reactive element and a variable capacitative element can be inserted into the tip of the stub or a midpoint of the stub, thereby changing the reactance component.

Figure 12:
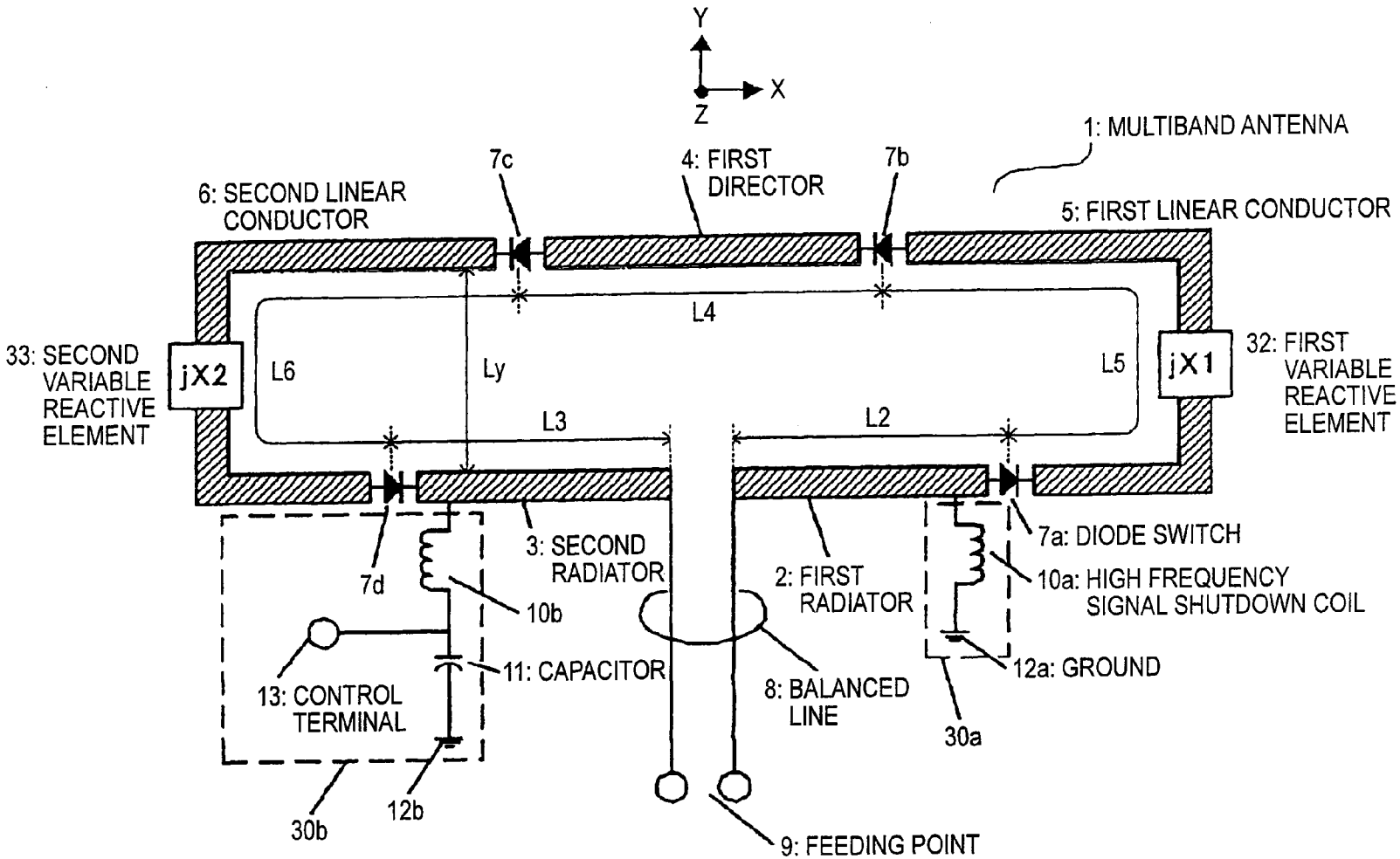
[FIG. 12] Another schematic configuration example of a multiband antenna to which reactive elements are added according to the first embodiment of the invention.

A similar advantage can also be provided if the first and second variable reactive elements 32 and 33 are inserted into midpoints of the first and second linear conductors 5 and 6 as shown in FIG. 12. The configuration as in FIG. 12 is adopted, whereby, for example, when the control voltage is applied to the control terminal 13, namely, when the antenna is operated as the loop antenna, the reactance values of the variable reactive elements 32 and 33 are controlled, whereby it is made possible to control the frequency at the loop antenna operation time.

In the embodiment, the components of the antenna are described as the linear conductors. However, for example, a pattern of the components of the antenna may be formed by etching, etc., on a dielectric substrate, needless to say. Such a configuration is adopted, whereby it is made possible to miniaturize the antenna because of the shortening effect of the wavelength caused by the dielectric constant of the dielectric substrate.

In the description of the embodiment, a negative control voltage is applied for control of the diode switches 7*a* to 7*d*, but the voltage need not be limited to the negative control voltage, needless to say. For example, to control the diode switches 7*a* to 7*d* by applying a positive control voltage, the directions of the diode switches 7*a* to 7*d* may be all set to opposite directions or the control circuits 30*a* and 30*b* may be inverted right and left, the capacitor 11 and the control terminal 13 may be connected to the first radiator 2 side and the second radiator 2 side may be grounded directly to the ground 12*b*.

In the description of the embodiment, the diode switches 7*a* to 7*d* are used as the switches, but the switches are not limited to them. For example, other switch circuits such as switches using the FET (Field-Effect Transistor) or MEMS (Micro Electro Mechanical System) technology may be used. Further, an SPST switch, etc., incorporating a control circuit may be used. Accordingly, the control circuits 30*a* and 30*b* can be removed and the characteristic of the multiband antenna can be made stable.

In the embodiment, the balanced line 8 is used as the feeding line from the feeding point 9 to the radiator 2, 3, but the invention is not limited to it; an unbalanced line such as a microstrip line may be used. Since the effect of GND on the antenna can be suppressed by using the balanced line 8, if the antenna is installed on a small mobile terminal, etc., the characteristic can be made stable independently of the size of the board where the antenna is installed, but a balanced-to-unbalanced line conversion circuit (balun) becomes necessary to connect to the switch, etc., positioned at the later stage of the antenna. On the other hand, to use an unbalanced line as the feeding line, for example, the unbalanced line is connected to the first radiator 2 and the second radiator 3 is grounded to GND, whereby it is made possible to operate the antenna. In this case, a balanced-to-unbalanced line conversion circuit (balun) need not be provided and it is made possible to decrease the number of parts.

Second Embodiment

Figure 3:
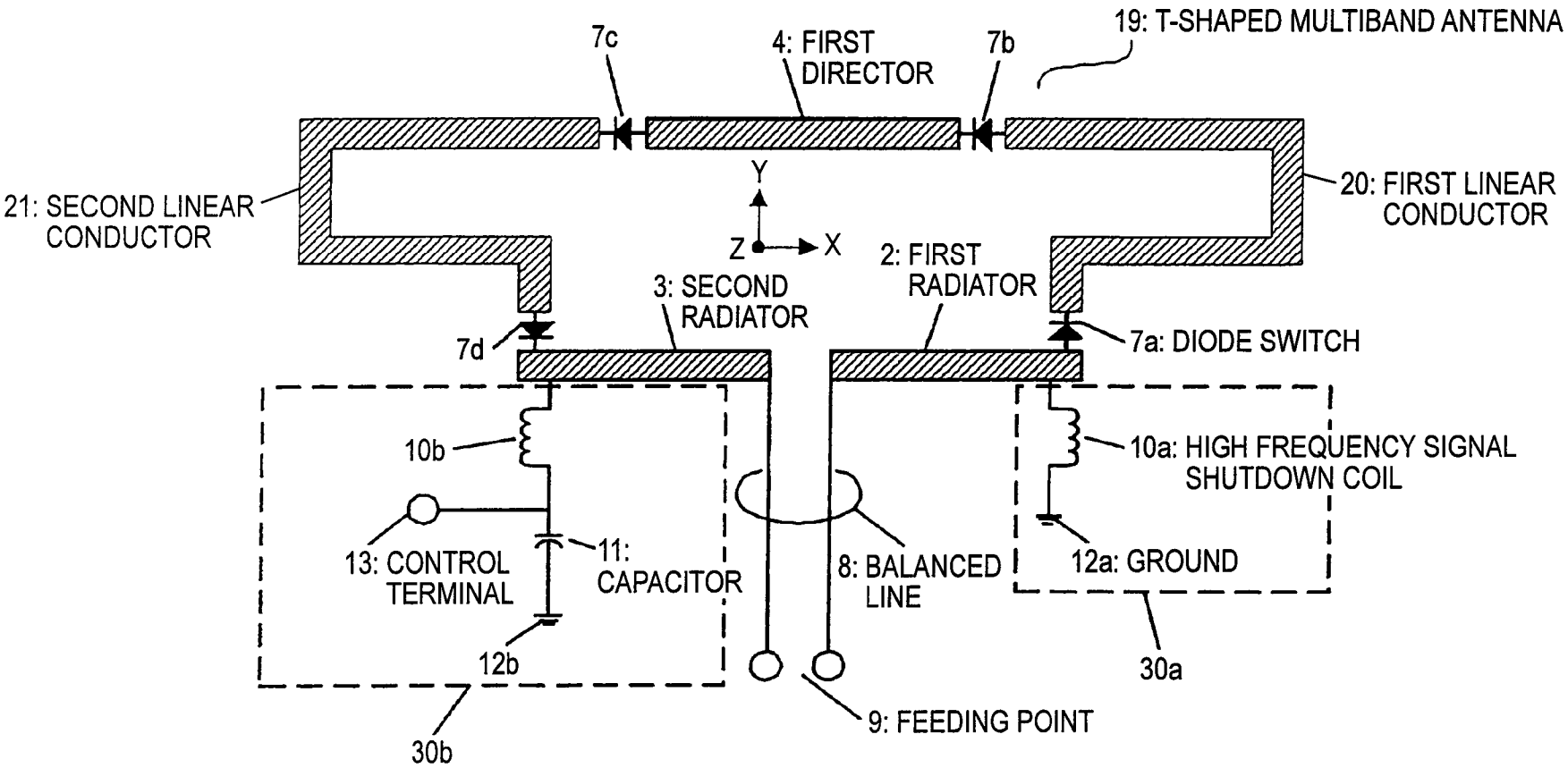
[FIG. 3] A schematic configuration drawing of a multiband antenna according to a second embodiment of the invention.

FIG. 3 is a schematic configuration drawing of a convex multiband antenna 19 according to a second embodiment of the invention. In FIG. 3, a first conductor 20 is provided in place of the first conductor 5 in FIG. 1 and a second conductor 21 is provided in place of the second conductor 6 in FIG. 1. Other components are the same as those of the first embodiment described with reference to FIG. 1.

In the configuration, the operation is as follows: The basic operation is as described in the first embodiment. The first conductor 20 and the second conductor 21 are shaped as shown in FIG. 3 for shaping a loop antenna like a convex form, whereby the currents of the first and second conductors 20 and 21 in the vicinities of first and second radiators 2 and 3 flow in the Y direction in FIG. 3; whereas, the currents flowing into the first and second radiators 2 and 3 are in the X direction in FIG. 3. Thus, the current flow directions differ 90 degrees.

Thus, if ends of the first and second conductors 20 and 21 are positioned in the proximities of the first and second radiators 2 and 3 at the two-element Yagi-Uda antenna operation time, electromagnetic field coupling can be minimized and the two-element Yagi-Uda antenna is not affected by the first, second conductor 20, 21 and it is made possible to keep good VSWR (Voltage Standing Wave Ratio), directional characteristic, etc.

As described above, the first and second conductors 20 and 21 are folded for forming the convex multiband antenna 19, whereby it is made possible to configure a multiband antenna whose directional characteristic can be switched 90 degrees at the same time as the resonance frequency is switched corresponding to the frequency band of a different communication mode and when diode switches 7*a* to 7*d* are turned on and off, it is made possible to maintain good antenna characteristic.

Further, a radio is configured using the multiband antenna shown in the embodiment, so that the characteristic of the antenna can be changed in response to a different communication mode for improving the performance of the radio and it is made possible to provide a highly reliable radio.

In the embodiment, the components of the antenna are described as the linear conductors. However, for example, a pattern of the components of the antenna may be formed by etching, etc., on a dielectric substrate. Such a configuration is adopted, whereby it is made possible to miniaturize the antenna because of the shortening effect of the wavelength caused by the dielectric constant of the dielectric substrate.

As control circuits 30*a* and 30*b* for applying a control voltage to the diode switches 7*a* to 7*d*, choke coils 10*a* and 10*b* may be used as shown in FIG. 3 or the control circuits 30*a* and 30*b* may be formed of resonance circuits 17*a* and 17*b* made up of first and second stubs 14*a*, 14*b*, 18*a*, 18*b*, capacitors 15*a* and 15*b*, and coils 16*a* and 16*b* as shown in FIG. 2, needless to say.

In the description of the embodiment, a negative control voltage is applied for control of the diode switches 7*a* to 7*d*, but the voltage need not be limited to the negative control voltage, needless to say. For example, to control the diode switches 7*a* to 7*d* by applying a positive control voltage, the directions of the diode switches 7*a* to 7*d* may be all set to opposite directions or the control circuits 30*a* and 30*b* may be inverted right and left, a capacitor 11 and a control terminal 13 may be connected to the first radiator 2 side and the second radiator 2 side may be grounded directly to a ground 12*b*.

In the description of the embodiment, the diode switches 7*a* to 7*d* are used as the switches, but the switches are not limited to them. For example, other switch circuits such as switches using the FET or MEMS technology may be used. Further, an SPST switch, etc., incorporating a control circuit may be used. Accordingly, the control circuits 30*a* and 30*b* can be removed and the characteristic of the multiband antenna can be made stable.

In the embodiment, a balanced line 8 is used as the feeding line from a feeding point 9 to the radiator 2, 3, but the invention is not limited to it; an unbalanced line such as a microstrip line may be used. Since the effect of GND on the antenna can be suppressed by using the balanced line 8, if the antenna is installed on a small mobile terminal, etc., the characteristic can be made stable independently of the size of the board where the antenna is installed, but a balanced-to-unbalanced line conversion circuit (balun) becomes necessary to connect to the switch, etc., positioned at the later stage of the antenna. On the other hand, to use an unbalanced line as the feeding line, for example, the unbalanced line is connected to the first radiator 2 and the second radiator 3 is grounded to GND, whereby it is made possible to operate the antenna. In this case, a balanced-to-unbalanced line conversion circuit (balun) need not be provided and it is made possible to decrease the number of parts.

Third Embodiment

Figure 4:
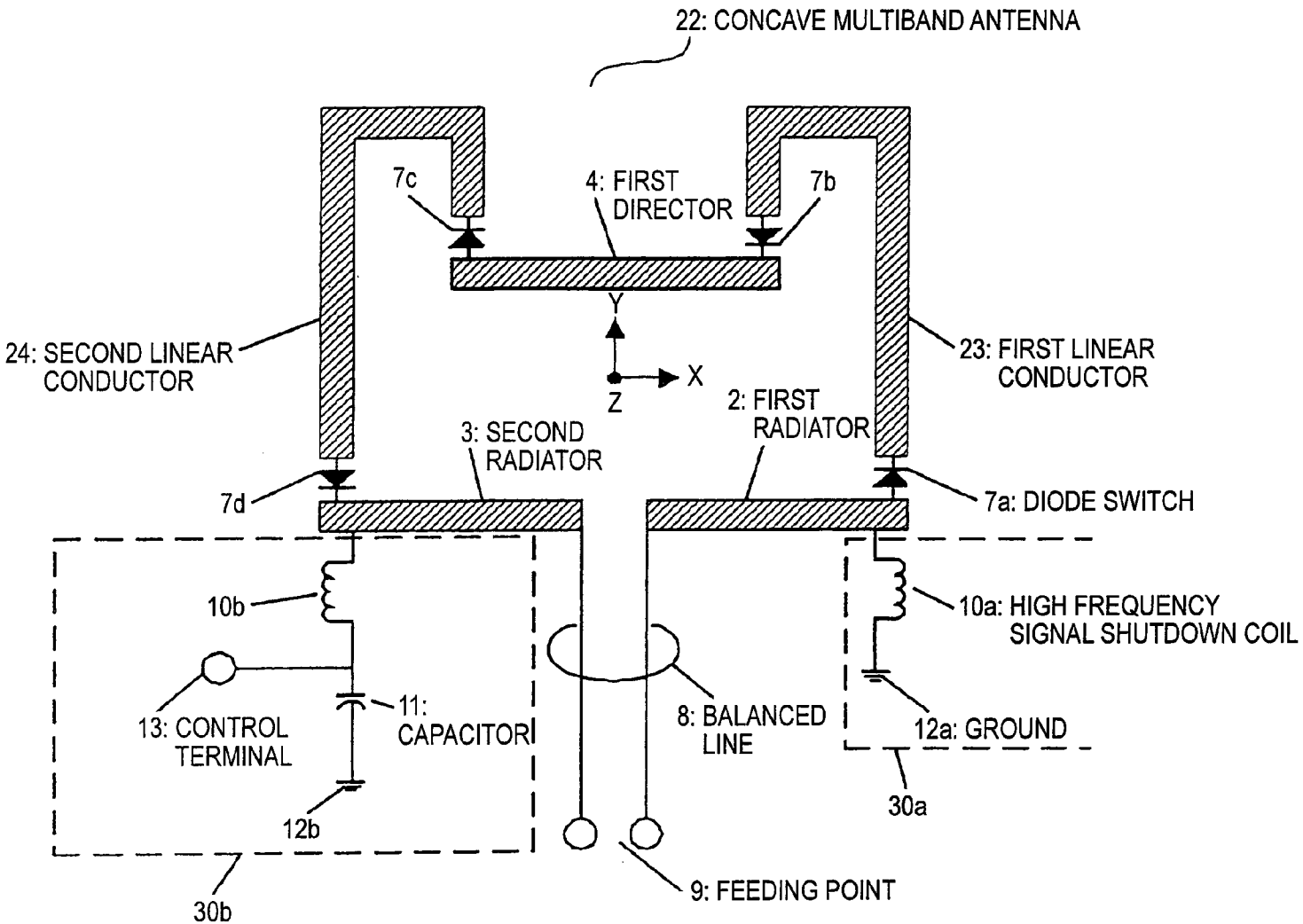
[FIG. 4] A schematic configuration drawing of a multiband antenna according to a third embodiment of the invention.

FIG. 4 is a schematic configuration drawing of a concave multiband antenna 22 according to a third embodiment of the invention. In FIG. 4, a first conductor 23 is provided in place of the first conductor 5 in FIG. 1 and a second conductor 24 is provided in place of the second conductor 6 in FIG. 1. Other components are the same as those of the first embodiment described with reference to FIG. 1.

In the configuration, the operation is as follows: The basic operation is as described in the first embodiment. The first conductor 23 and the second conductor 24 are shaped as shown in FIG. 4 for shaping a loop antenna like a concave form, whereby the currents of the first and second conductors 23 and 24 in the vicinities of first and second radiators 2 and 3 flow in the Y direction in FIG. 4; whereas, the currents flowing into the first and second radiators 2 and 3 are in the X direction in FIG. 4. Thus, the current flow directions differ 90 degrees.

The currents of the first and second conductors 23 and 24 in the vicinities of a first director 4 flow in the Y direction in FIG. 4; whereas, the current flowing into the first director 4 is in the X direction in FIG. 4. Thus, the current flow directions differ 90 degrees.

Thus, if ends of the first and second conductors 23 and 24 are positioned in the proximities of the first and second radiators 2 and 3 and the first director 4 at the two-element Yagi-Uda antenna operation time, electromagnetic field coupling can be minimized and the two-element Yagi-Uda antenna is not affected by the first, second conductor 23, 24 and it is made possible to keep good VSWR, directional characteristic, etc.

As described above, the first and second conductors 23 and 24 are used to form the concave multiband antenna 22, whereby it is made possible to configure a multiband antenna whose directional characteristic can be switched 90 degrees at the same time as the resonance frequency is switched corresponding to the frequency band of a different communication mode and when diode switches 7*a* to 7*d* are turned on and off, it is made possible to maintain good antenna characteristic.

Further, a radio is configured using the multiband antenna shown in the embodiment, so that the characteristic of the antenna can be changed in response to a different communication mode for improving the performance of the radio and it is made possible to provide a highly reliable radio.

In the embodiment, the components of the antenna are described as the linear conductors. However, for example, a pattern of the components of the antenna may be formed by etching, etc., on a dielectric substrate. Such a configuration is adopted, whereby it is made possible to miniaturize the antenna because of the shortening effect of the wavelength caused by the dielectric constant of the dielectric substrate.

As control circuits 30*a* and 30*b* for applying a control voltage to the diode switches 7*a* to 7*d*, choke coils 10*a* and 10*b* may be used as shown in FIG. 4 or the control circuits 30*a* and 30*b* may be formed of resonance circuits 17*a* and 17*b* made up of first and second stubs 14*a*, 14*b*, 18*a*, 18*b*, capacitors 15*a* and 15*b*, and coils 16*a* and 16*b* as shown in FIG. 2, needless to say.

In the description of the embodiment, a negative control voltage is applied for control of the diode switches 7*a* to 7*d*, but the voltage need not be limited to the negative control voltage, needless to say. For example, to control the diode switches 7*a* to 7*d* by applying a positive control voltage, the directions of the diode switches 7*a* to 7*d* may be all set to opposite directions or the control circuits 30*a* and 30*b* may be inverted right and left, a capacitor 11 and a control terminal 13 may be connected to the first radiator 2 side and the second radiator 2 side may be grounded directly to a ground 12*b*.

In the description of the embodiment, the diode switches 7*a* to 7*d* are used as the switches, but the switches are not limited to them. For example, other switch circuits such as switches using the FET or MEMS technology may be used. Further, an SPST switch, etc., incorporating a control circuit may be used. Accordingly, the control circuits 30*a* and 30*b* can be removed and the characteristic of the multiband antenna can be made stable.

In the embodiment, a balanced line 8 is used as the feeding line from a feeding point 9 to the radiator 2, 3, but the invention is not limited to it; an unbalanced line such as a microstrip line may be used. Since the effect of GND on the antenna can be suppressed by using the balanced line 8, if the antenna is installed on a small mobile terminal, etc., the characteristic can be made stable independently of the size of the board where the antenna is installed, but a balanced-to-unbalanced line conversion circuit (balun) becomes necessary to connect to the switch, etc., positioned at the later stage of the antenna. On the other hand, to use an unbalanced line as the feeding line, for example, the unbalanced line is connected to the first radiator 2 and the second radiator 3 is grounded to GND, whereby it is made possible to operate the antenna. In this case, a balanced-to-unbalanced line conversion circuit (balun) need not be provided and it is made possible to decrease the number of parts.

Fourth Embodiment

Figure 5:
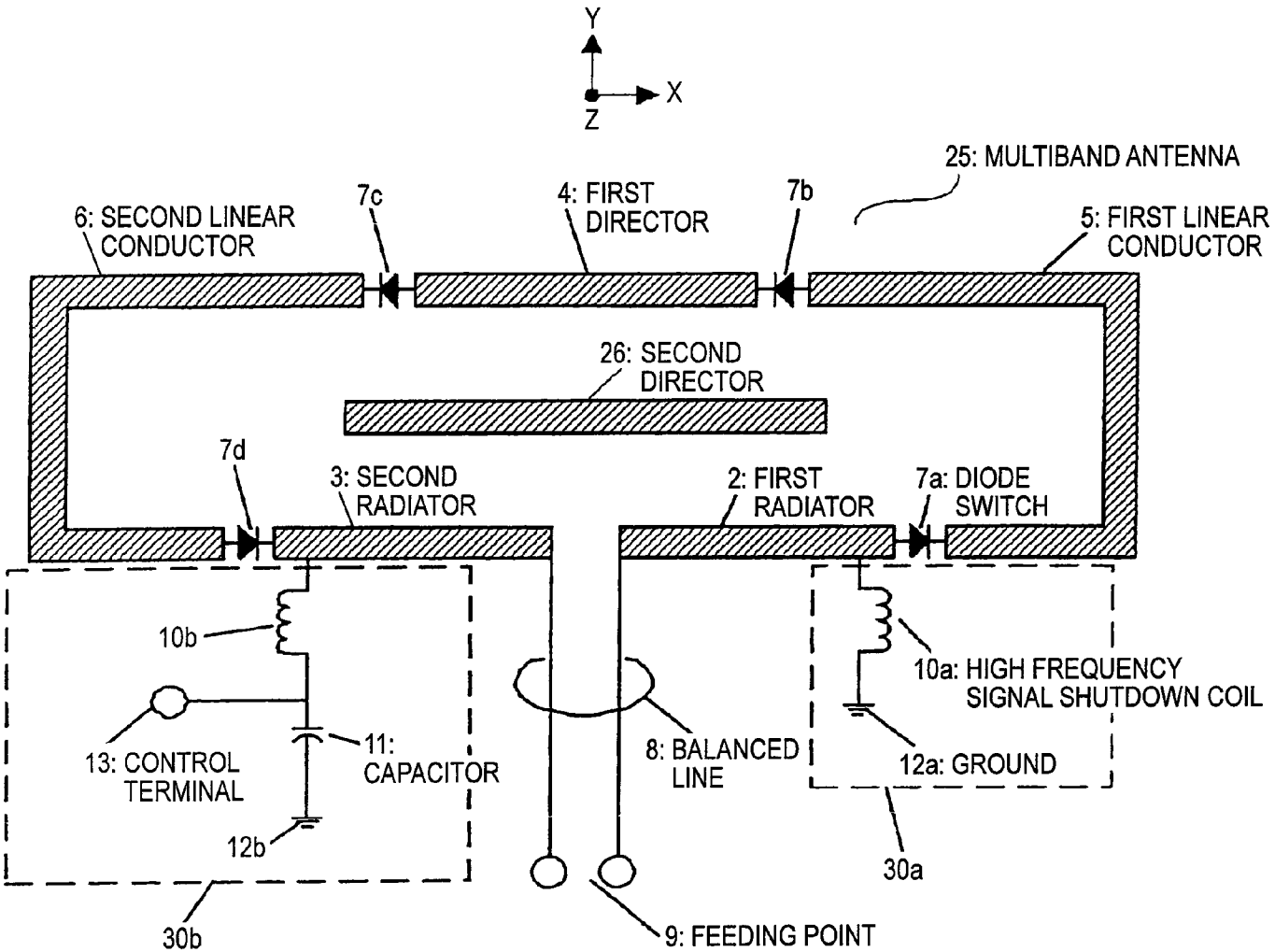
[FIG. 5] A schematic configuration drawing of a multiband antenna to which a second director is added according to a fourth embodiment of the invention.

FIG. 5 is a schematic configuration drawing of a multiband antenna 25 according to a fourth embodiment of the invention. In FIG. 5, numeral 26 denotes a second director. Other components are the same as those of the first embodiment described with reference to FIG. 1.

In the configuration, the operation is as follows: The basic operation is as described in the first embodiment. The second director 26 is placed at a position where it is parallel with first and second radiators 2 and 3 and a first director 4 and is bilaterally symmetrical with respect to the Y axis as shown in FIG. 5, whereby the first and second radiators 2 and 3 and the first director 4 and the second director 26 are coupled in a state in which diode switches 7*a* to 7*d* are out of conduction, forming a three-element Yagi-Uda antenna.

Accordingly, the electromagnetic field coupling degree in the +Y direction is enhanced as viewed from the first and second radiators 2 and 3, so that the coupling effect of the first and second radiators 2 and 3 and first and second conductors 5 and 6 can be lessened relatively.

When the diode switches 7*a* to 7*d* are brought into conduction for operating the antenna as a loop antenna, the second director 26 exists at the center of the loop. An electric field produced by the loop antenna operation is in ±Z direction at the center of the loop and has the orthogonal relation to the direction of the current flowing into the second director 26 (±X direction) and thus theoretically coupling does not occur. Therefore, the second director 26 does not affect the antenna characteristic at the loop antenna operation time and good loop antenna operation is made possible.

As described above, the multiband antenna 25 using the second director 26 is formed, whereby it is made possible to configure a multiband antenna whose directional characteristic can be switched 90 degrees at the same time as the resonance frequency is switched corresponding to the frequency band of a different communication mode and when diode switches 7*a* to 7*d* are turned on and off, it is made possible to maintain good antenna characteristic.

Further, a radio is configured using the multiband antenna shown in the embodiment, so that the characteristic of the antenna can be changed in response to a different communication mode for improving the performance of the radio and it is made possible to provide a highly reliable radio.

In the embodiment, the components of the antenna are described as the linear conductors. However, for example, a pattern of the components of the antenna may be formed by etching, etc., on a dielectric substrate. Such a configuration is adopted, whereby it is made possible to miniaturize the antenna because of the shortening effect of the wavelength caused by the dielectric constant of the dielectric substrate.

As control circuits 30*a* and 30*b* for applying a control voltage to the diode switches 7*a* to 7*d*, choke coils 10*a* and 10*b* may be used as shown in FIG. 5 or the control circuits 30*a* and 30*b* may be formed of resonance circuits 17*a* and 17*b* made up of first and second stubs 14*a*, 14*b*, 18*a*, 18*b*, capacitors 15*a* and 15*b*, and coils 16*a* and 16*b* as shown in FIG. 2, needless to say.

In the description of the embodiment, a negative control voltage is applied for control of the diode switches 7*a* to 7*d*, but the voltage need not be limited to the negative control voltage, needless to say. For example, to control the diode switches 7*a* to 7*d* by applying a positive control voltage, the directions of the diode switches 7*a* to 7*d* may be all set to opposite directions or the control circuits 30*a* and 30*b* may be inverted right and left, a capacitor 11 and a control terminal 13 may be connected to the first radiator 2 side and the second radiator 2 side may be grounded directly to a ground 12*b*.

In the description of the embodiment, the diode switches 7*a* to 7*d* are used as the switches, but the switches are not limited to them. For example, other switch circuits such as switches using the FET or MEMS technology may be used. Further, an SPST switch, etc., incorporating a control circuit may be used. Accordingly, the control circuits 30*a* and 30*b* can be removed and the characteristic of the multiband antenna can be made stable.

In the embodiment, a balanced line 8 is used as the feeding line from a feeding point 9 to the radiator 2, 3, but the invention is not limited to it; an unbalanced line such as a microstrip line may be used. Since the effect of GND on the antenna can be suppressed by using the balanced line 8, if the antenna is installed on a small mobile terminal, etc., the characteristic can be made stable independently of the size of the board where the antenna is installed, but a balanced-to-unbalanced line conversion circuit (balun) becomes necessary to connect to the switch, etc., positioned at the later stage of the antenna. On the other hand, to use an unbalanced line as the feeding line, for example, the unbalanced line is connected to the first radiator 2 and the second radiator 3 is grounded to GND, whereby it is made possible to operate the antenna. In this case, a balanced-to-unbalanced line conversion circuit (balun) need not be provided and it is made possible to decrease the number of parts.

Fifth Embodiment

Figure 6:
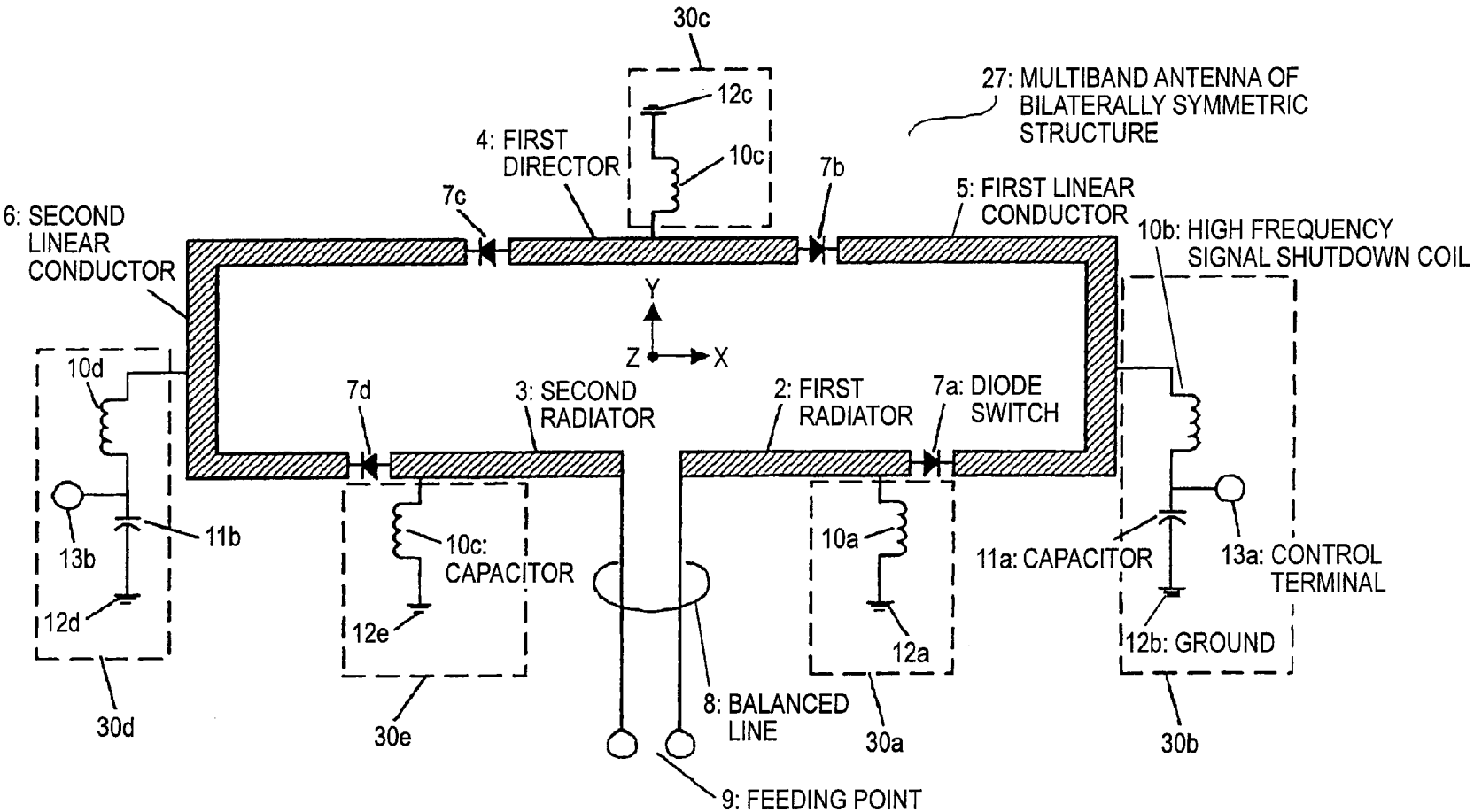
[FIG. 6] A schematic configuration drawing of a multiband antenna of a bilaterally symmetric structure according to a fifth embodiment of the invention.

FIG. 6 is a schematic configuration drawing of a multiband antenna 27 of a bilaterally symmetric structure according to a fifth embodiment of the invention. In FIG. 6, basic components are the same as those of the first embodiment described with reference to FIG. 1; diode switches 7*a* to 7*d* are provided with two control terminals 13*a* and 13*b* and choke coils 10*a*, 10*e*, and 10*c* are connected to first and second radiators 2 and 3 and a first conductor respectively and are grounded by grounds 12*a*, 12*e*, and 12*c*.

Choke coils 10*b* and 10*d* are also connected to first and second conductors 5 and 6 and control terminals 13*a* and 13*b* are connected and capacitors 11*a* and 11*b* for grounding a high frequency signal are connected and are grounded by grounds 12*b* and 12*d*, thereby forming control circuits 30*a* to 30*e*.

In the configuration, the operation is as follows: The basic operation is as described in the first embodiment. The antenna can be operated as a loop antenna by applying negative voltages at the same level to the control terminals 13*a* and 13*b* connected to the first conductor 5 and the second conductor 6. Voltage is applied to neither the control terminal 13*a* nor the control terminal 13*b*, whereby the antenna can be operated as a two-element Yagi-Uda antenna as in the first embodiment.

Further, for example, the levels of the negative voltages applied to the control terminals 13*a* and 13*b* are changed on the first conductor 5 side and the second conductor 6 side, whereby it is made possible to control the isolation characteristic and the passage characteristic in the right diode switches 7*a* and 7*b* and the left diode switches 7*c* and 7*d* and control the directional characteristic at the two-element Yagi-Uda antenna operation time.

As described above, the antenna is made up of the first and second radiators 2 and 3, the first director 4, the first and second conductors 5 and 6, and the diode switches 7*a* to 7*d* and the diode switches 7*a* to 7*d* are turned on and off according to the control voltage, whereby the operation of the antenna can be switched between the loop antenna and the two-element Yagi-Uda antenna, so that it is made possible to implement a multiband antenna whose directional characteristic is switched 90 degrees at the same time as the resonance frequency is switched.

Further, the multiband antenna 27 of the bilaterally symmetric structure includes the two control terminals 13*a* and 13*b* and the left and right diode switches 7*a* to 7*d* can be controlled separately, whereby it is made possible to control the directional characteristic at the two-element Yagi-Uda antenna operation time.

Further, a radio is configured using the multiband antenna shown in the embodiment, so that the characteristic of the antenna can be changed in response to a different communication mode for improving the performance of the radio and it is made possible to provide a highly reliable radio.

In the embodiment, the components of the antenna are described as the linear conductors. However, for example, a pattern of the components of the antenna maybe formed by etching, etc., on a dielectric substrate. Such a configuration is adopted, whereby it is made possible to miniaturize the antenna because of the shortening effect of the wavelength caused by the dielectric constant of the dielectric substrate.

As the control circuits 30*a* to 30*e* for applying a control voltage to the diode switches 7*a* to 7*d*, the choke coils 10*a* to 10*e* as shown in FIG. 6 may be used or the control circuits 30*a* to 30*e* may be formed of resonance circuits such as a resonance circuit 17*a* made up of first and second stubs 14*a* and 18*a*, a capacitor 15*a*, and a coil 16*a* as shown in FIG. 2, needless to say.

In the description of the embodiment, a negative control voltage is applied for control of the diode switches 7*a* to 7*d*, but the voltage need not be limited to the negative control voltage, needless to say. For example, to control the diode switches 7*a* to 7*d* by applying a positive control voltage, the directions of the diode switches 7*a* to 7*d* may be all set to opposite directions or the choke coils 10*a*, 10*e*, and 10*c* connected to the first radiator 2, the second radiator 3, and the first director 4 may be provided with control terminals 13*a*, 13*b*, and 13*c* and the choke coils 10*b* and 10*d* connected to the first conductor 5 and the second conductor 6 may be grounded by the grounds 12*b* and 12*d*.

In the configuration of the embodiment, the first and second conductors 5 and 6 maybe replaced with the first and second conductors 20 and 21 shown in the second embodiment or may be replaced with the first and second conductors 23 and 24 shown in the third embodiment. Further, the antenna may include the second director 26 as shown in the fourth embodiment, needless to say.

In the description of the embodiment, the diode switches 7*a* to 7*d* are used as the switches, but the switches are not limited to them. For example, other switch circuits such as switches using the FET or MEMS technology may be used. Further, an SPST switch, etc., incorporating a control circuit may be used. Accordingly, the control circuits 30*a* to 30*e* can be removed and the characteristic of the multiband antenna can be made stable.

In the embodiment, a balanced line 8 is used as the feeding line from a feeding point 9 to the radiator 2, 3, but the invention is not limited to it; an unbalanced line such as a microstrip line may be used. Since the effect of GND on the antenna can be suppressed by using the balanced line 8, if the antenna is installed on a small mobile terminal, etc., the characteristic can be made stable independently of the size of the board where the antenna is installed, but a balanced-to-unbalanced line conversion circuit (balun) becomes necessary to connect to the switch, etc., positioned at the later stage of the antenna. On the other hand, to use an unbalanced line as the feeding line, for example, the unbalanced line is connected to the first radiator 2 and the second radiator 3 is grounded to GND, whereby it is made possible to operate the antenna. In this case, a balanced-to-unbalanced line conversion circuit (balun) need not be provided and it is made possible to decrease the number of parts.

Sixth Embodiment

Figure 7:
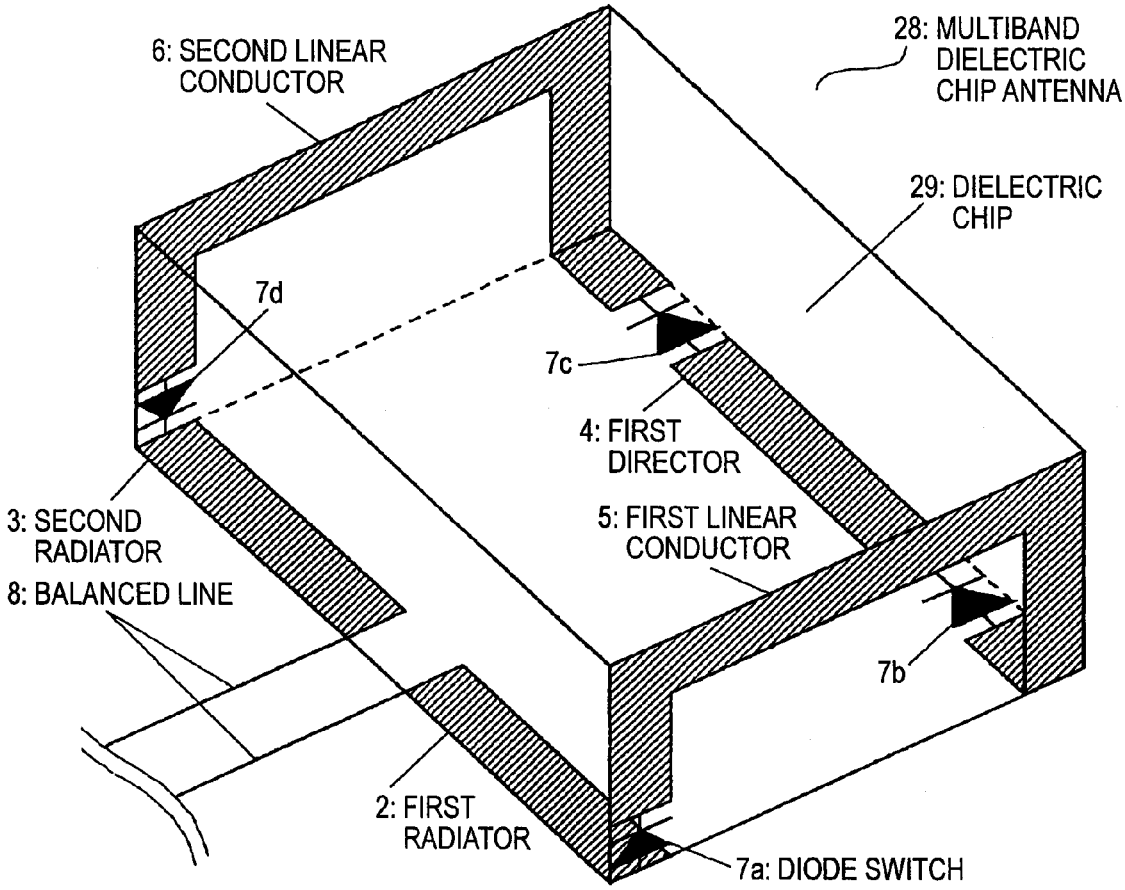
[FIG. 7] A schematic configuration drawing of a multiband dielectric chip antenna of a three-dimensional structure according to a sixth embodiment of the invention.

FIG. 7 is a schematic configuration drawing of a multiband dielectric chip antenna 28 according to a sixth embodiment of the invention. In FIG. 7, basic components are the same as those of the first embodiment described with reference to FIG. 1 and therefore control circuits 30*a* and 30*b* of diode switches 7*a* to 7*d* (choke coils 10*a* and 10*b*, a capacitor 11, a control terminal 13, etc.,) will not be discussed again.

As shown in FIG. 7, first and second radiators 2 and 3, a first director 4, first and second conductors 5 and 6, and diode switches 7*a* to 7*d* are placed three-dimensionally on the surface of a dielectric chip 29, whereby the mount area can be lessened as compared with two-dimensional placement of the components.

Since the first and second radiators 2 and 3 and the first and second conductors 5 and 6 can be placed at right angles, the effect of minimizing both coupling can also be provided.

As described above, the antenna is made up of the first and second radiators 2 and 3, the first director 4, the first and second conductors 5 and 6, and the diode switches 7*a* to 7*d* and the diode switches 7*a* to 7*d* are turned on and off according to the control voltage, whereby the operation of the antenna can be switched between the loop antenna and the two-element Yagi-Uda antenna, so that it is made possible to implement a multiband antenna whose directional characteristic is switched 90 degrees at the same time as the resonance frequency is switched.

Further, the components making up the antenna are placed on the surface of the dielectric chip 29, whereby while miniaturization of the mount area is accomplished, when the diode switches 7*a* to 7*d* are turned on and off, it is made possible to maintain good antenna characteristic.

Further, a radio is configured using the multiband antenna shown in the embodiment, so that the characteristic of the antenna can be changed in response to a different communication mode for improving the performance of the radio and it is made possible to provide a highly reliable radio.

In the description of the embodiment, the first and second radiators 2 and 3, the first director 4, and the first and second conductors 5 and 6 are formed on the surface of the dielectric chip 29, but the invention is not limited to the configuration and the components may be embedded in the dielectric chip 29.

Figure 8:
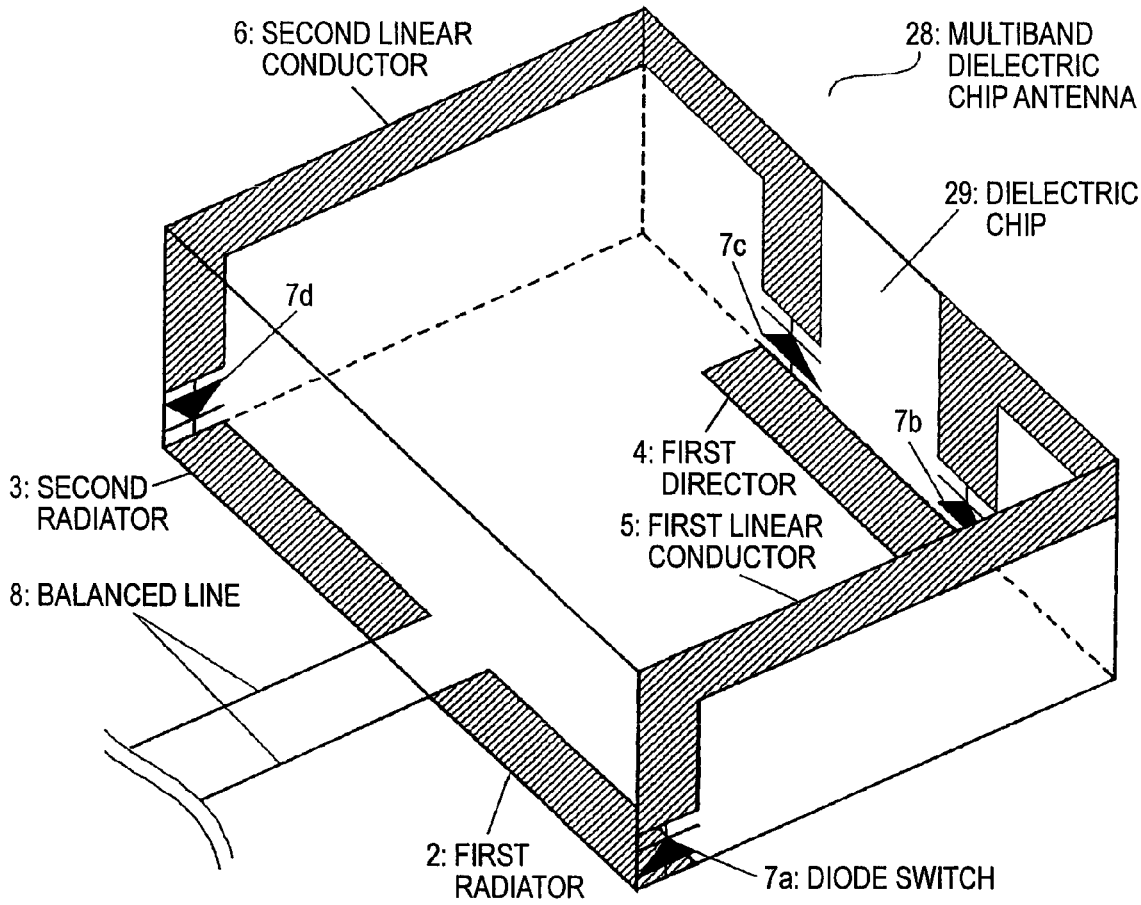
[FIG. 8] A schematic configuration drawing of a multiband dielectric chip antenna of a three-dimensional structure according to the sixth embodiment of the invention.
Figure 9:
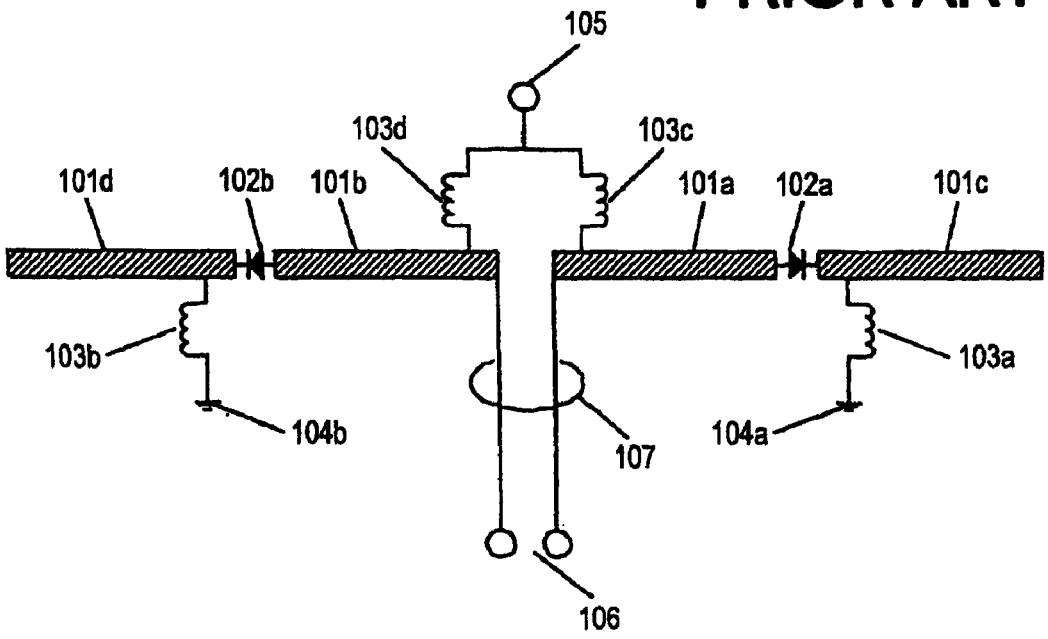
FIG. 9 PRIOR ART
[FIG. 9] A schematic configuration drawing of a multifrequency share antenna in a related art.
Figure 10:
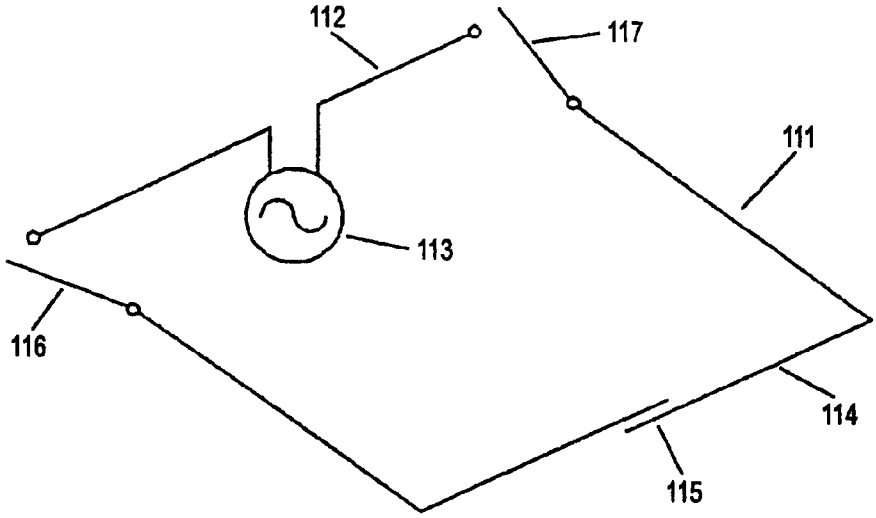
FIG. 10 PRIOR ART
[FIG. 10] A schematic configuration drawing of an antenna in a related art.

When the first and second conductors 5 and 6 are placed on the surface of the dielectric chip 29, the first director 4 and the first and second conductors 5 and 6 may be placed at right angles as shown in FIG. 8. Such a configuration is adopted, whereby it is made possible to suppress not only coupling the first and second radiators 2 and 3 and the first and second conductors 5 and 6, but also coupling the first director 4 and the first and second conductors 5 and 6.

As the control circuits 30*a* and 30*b* for applying a control voltage to the diode switches 7*a* to 7*d*, the choke coils 10*a* and 10*b* as shown in FIG. 1 may be used or the control circuits 30*a* and 30*b* may be formed of resonance circuits such as a resonance circuit 17*a* made up of first and second stubs 14*a* and 18*a*, a capacitor 15*a*, and a coil 16*a* as shown in FIG. 2, needless to say.

In the description of the embodiment, a negative control voltage is applied for control of the diode switches 7*a* to 7*d*, but the voltage need not be limited to the negative control voltage, needless to say. For example, to control the diode switches 7*a* to 7*d* by applying a positive control voltage, the directions of the diode switches 7*a* to 7*d* may be all set to opposite directions or the control circuits 30*a* and 30*b* may be inverted right and left, a capacitor 11 and a control terminal 13 may be connected to the first radiator 2 side and the second radiator 2 side may be grounded directly to a ground 12*b*.

Control circuits 30*a* to 30*e* of the diode switches 7*a* to 7*d* may be of bilaterally symmetric structure and the left and right diode switches 7*a* to 7*d* may be able to be controlled separately with two control terminals as described in the fifth embodiment.

In the description of the embodiment, the diode switches 7*a* to 7*d* are used as the switches, but the switches are not limited to them. For example, other switch circuits such as switches using the FET or MEMS technology may be used. Further, an SPST switch, etc., incorporating a control circuit may be used. Accordingly, the control circuits 30*a* and 30*b* can be removed and the characteristic of the multiband antenna can be made stable.

In the embodiment, a balanced line 8 is used as the feeding line from a feeding point 9 to the radiator 2, 3, but the invention is not limited to it; an unbalanced line such as a microstrip line may be used. Since the effect of GND on the antenna can be suppressed by using the balanced line 8, if the antenna is installed on a small mobile terminal, etc., the characteristic can be made stable independently of the size of the board where the antenna is installed, but a balanced-to-unbalanced line conversion circuit (balun) becomes necessary to connect to the switch, etc., positioned at the later stage of the antenna. On the other hand, to use an unbalanced line as the feeding line, for example, the unbalanced line is connected to the first radiator 2 and the second radiator 3 is grounded to GND, whereby it is made possible to operate the antenna. In this case, a balanced-to-unbalanced line conversion circuit (balun) need not be provided and it is made possible to decrease the number of parts.

While the invention has been described in detail with reference to the specific embodiments, it will be obvious to those skilled in the art that various changes and modifications can be made without departing from the spirit and the scope of the invention.

The present application is based on Japanese Patent Application (No. 2004-147267) filed on May 18, 2004 and Japanese Patent Application (No. 2005-042572) filed on Feb. 18, 2005, which are incorporated herein by reference.

INDUSTRIAL APPLICABILITY

The antenna apparatus according to the invention has the advantages that the resonance frequency can be changed as the diode switches are short-circuited and are opened and the directional characteristic can be changed 90 degrees in response to the frequency band, and is useful as a multiband antenna applied to a radio, etc., integrating a plurality of wireless systems. The antenna apparatus is also useful as a multiband antenna incorporated in a PC, etc., adapted to a plurality of wireless systems, for example, in addition to a radio.

The invention claimed is:

1. An antenna apparatus comprising:

a linear radiator;

a first linear director; and first and second linear conductors each being connected at one end to the radiator and at an opposite end to the first director through switches, wherein the first and second conductors are disposed symmetrically with respect to an orthogonal plane in the length direction of the radiator, wherein the radiator, the first director, the first conductor, and the second conductor are switched between a loop state in which they are connected like a loop and a separate state in which they are separate by switching the switches, and wherein in the loop state, the antenna apparatus operates as a loop antenna corresponding to a first frequency band, and in the separate state, the antenna apparatus operates as a Yagi-Uda antenna corresponding to a second frequency band.

2. The antenna apparatus according to claim 1, wherein the radiator, the first director, and the first and second conductors connected through the switches form a rectangular structure.

3. The antenna apparatus according to claim 1, comprising first and second variable reactive elements connected to the first and second conductors.

4. The antenna apparatus according to claim 3, wherein the first and second variable reactive elements are inserted onto the lines of the first and second conductors.

5. The antenna apparatus according to claim 1, wherein one ends of the first and second conductors are connected at right angles to at least either the radiator or the first director.

6. The antenna apparatus according to claim 5, wherein the radiator, the first director, and the first and second conductors connected through the switches form a convex structure on the same plane.

7. The antenna apparatus according to claim 5, wherein the radiator, the first director, and the first and second conductors connected through the switches form a concave structure on the same plane.

8. The antenna apparatus according to claim 1, comprising a second linear director placed between the radiator and the first director.

9. The antenna apparatus according to claim 8, wherein the first director and the second linear director are placed in parallel with the radiator.

10. The antenna apparatus according to claim 1, wherein power is fed into the radiator using a balanced line.

11. The antenna apparatus according to claim 1, wherein power is fed into the radiator using an unbalanced line.

12. The antenna apparatus according to claim 1, wherein the radiator, the director, and the first and second conductors are formed according to a conductor pattern on a dielectric substrate.

13. The antenna apparatus according to claim 1, wherein the radiator, the first director, and the first and second conductors are formed on the surface of and/or inside a dielectric chip.

14. The antenna apparatus according to claim 1, wherein the switch consists of diodes.

15. The antenna apparatus according to claim 1, wherein the switch consists of MEMS switches.

16. A radio using the antenna apparatus according to claim 1.

17. The antenna apparatus according to claim 1, wherein the first frequency band is a low frequency band, and the second frequency band is a high frequency band.

18. The antenna apparatus according to claim 1, wherein the first frequency band is for voice communications, and the second frequency band is for data communications.

19. The antenna apparatus according to claim 1, comprising a control unit which controls switching the switches.

20. The antenna apparatus according to claim 19, wherein the radiator comprises first and second linear radiators having the same length, and wherein the control unit comprises:

a first choke coil connected at one end to the first radiator and grounded at an opposite end; and a second choke coil connected at one end to the second radiator and at an opposite end to a control terminal and bypass capacitor grounded at one end.

21. The antenna apparatus according to claim 19, wherein the radiator comprises first and second linear radiators having the same length, and wherein the control unit comprises:

a first choke coil connected at one end to the first and second radiators and the first director and grounded at an opposite end; and a second choke coil connected at one end to the first and second conductors and at an opposite end to a control terminal and a bypass capacitor grounded at one end.

22. The antenna apparatus according to claim 19, wherein the radiator comprises first and second linear radiators having the same length, wherein the control unit comprises:

a first stub connected at one end to the first radiator;

a first resonance circuit connected at one end to an opposite end of the first stub and grounded at an opposite end, the first resonance circuit for resonating in a first frequency band;

a second stub connected at one end to the opposite end of the first stub and grounded at an opposite end;

a third stub connected at one end to the second radiator;

a second resonance circuit connected at one end to an opposite end of the third stub and grounded at an opposite end, the second resonance circuit for resonating in the first frequency band; and a fourth stub connected at one end to the opposite end of the third stub and at an opposite end to a control terminal and a bypass capacitor grounded at one end, and wherein the length of each of the first and third stubs becomes one quarter guide wavelength in the first frequency band and the sum of the lengths of the first and second stubs and the sum of the lengths of the third and fourth stubs become each one quarter guide wavelength in a second frequency band lower than the first frequency band.

23. The antenna apparatus according to claim 19, wherein the radiator comprises first and second linear radiators having the same length, wherein the control unit comprises:

a first stub connected at one end to the first and second radiators and the first director;

a first resonance circuit connected at one end to an opposite end of the first stub and grounded at an opposite end, the first resonance circuit for resonating in a first frequency band;

a second stub connected at one end to the opposite end of the first stub and grounded at an opposite end;

a third stub connected at one end to the first and second conductors;

a second resonance circuit connected at one end to an opposite end of the third stub and grounded at an opposite end, the second resonance circuit for resonating in the first frequency band; and a fourth stub connected at one end to the opposite end of the third stub and at an opposite end to a control terminal and a bypass capacitor grounded at one end, and wherein the length of each of the first and third stubs becomes one quarter guide wavelength in the first frequency band and the sum of the lengths of the first and second stubs and the sum of the lengths of the third and fourth stubs become each one quarter guide wavelength in a second frequency band lower than the first frequency band.

* * * * *